US008038236B2

(12) United States Patent
Gauss et al.

(10) Patent No.: US 8,038,236 B2
(45) Date of Patent: Oct. 18, 2011

(54) DEVICE FOR PATTERNING WORKPIECES

(75) Inventors: Achim Gauss, Dornstetten/Hallwangen (DE); Ludwig Albrecht, Dornstetten-Aach (DE)

(73) Assignee: Homag Holzbearbeitungssysteme AG, Schopfloch (DE)

( * ) Notice: Subject to any disclaimer, the term of this patent is extended or adjusted under 35 U.S.C. 154(b) by 768 days.

(21) Appl. No.: 11/844,607

(22) Filed: Aug. 24, 2007

(65) Prior Publication Data

US 2008/0048388 A1 Feb. 28, 2008

(30) Foreign Application Priority Data

Aug. 25, 2006 (EP) ..... 06017767

(51) Int. Cl.
*B41J 3/00* (2006.01)

(52) U.S. Cl. ..... 347/4; 347/2; 347/8; 347/19

(58) Field of Classification Search ..... None
See application file for complete search history.

(56) References Cited

U.S. PATENT DOCUMENTS

| | | | |
|---|---|---|---|
| 3,811,915 | A | 5/1974 | Burrell et al. |
| 3,975,740 | A | 8/1976 | Distler |
| 4,017,869 | A | 4/1977 | Meyer |
| 4,720,301 | A | 1/1988 | Kito et al. |
| 4,814,795 | A | 3/1989 | Kuester et al. |
| 5,581,284 | A | 12/1996 | Hermanson |
| 5,810,487 | A | 9/1998 | Kano et al. |
| 5,869,138 | A | 2/1999 | Nishibori |
| 5,931,098 | A | 8/1999 | Bates |
| 5,935,331 | A | 8/1999 | Naka et al. |
| 5,986,680 | A | 11/1999 | Wen et al. |
| 6,053,231 | A | 4/2000 | Matsuguchi |
| 6,286,920 | B1 | 9/2001 | Ridgway |
| 6,358,220 | B1 | 3/2002 | Laugen et al. |
| 6,465,046 | B1 | 10/2002 | Hansson |
| 6,634,729 | B1 | 10/2003 | Schuman et al. |
| 6,635,142 | B1 | 10/2003 | Stula et al. |
| 6,694,872 | B1 | 2/2004 | LaBelle et al. |

(Continued)

FOREIGN PATENT DOCUMENTS

CA 2492712 12/2004

(Continued)

OTHER PUBLICATIONS

U.S. Appl. No. 11/632,461, filed Oct. 22, 2007.

(Continued)

*Primary Examiner* — Matthew Luu
*Assistant Examiner* — Justin Seo
(74) *Attorney, Agent, or Firm* — Baker Botts L.L.P.

(57) ABSTRACT

The invention provides a device for patterning workpieces, having: an ink-jet printing means having a plurality of nozzles from which drops of ink can be expelled, a workpiece carrier means for carrying the workpiece to be patterned, a conveyor means for bringing about a relative movement between the workpiece to be patterned and the printing means, and a detection means for detecting the relative position between the ink-jet printing means and at least one surface to be patterned of the respective workpiece to be patterned. The device according to the invention is characterised in that the detection means is disposed and configured so as to be in a predetermined, fixed relationship to the ink-jet printing means and/or to detect at least the distance between the ink-jet printing means and at least one surface to be patterned of the respective workpiece to be patterned, at least during printing.

18 Claims, 5 Drawing Sheets

U.S. PATENT DOCUMENTS

| | | | | |
|---|---|---|---|---|
| 6,789,876 | B2 * | 9/2004 | Barclay et al. | 347/37 |
| 6,894,709 | B2 | 5/2005 | Pferrer | |
| 7,357,959 | B2 | 4/2008 | Bauer | |
| 7,691,294 | B2 | 4/2010 | Chung et al. | |
| 7,762,647 | B2 | 7/2010 | Mehta et al. | |
| 2001/0003871 | A1 | 6/2001 | Patton et al. | |
| 2001/0005942 | A1 | 7/2001 | Patton et al. | |
| 2001/0049010 | A1 | 12/2001 | Fenzi | |
| 2002/0024577 | A1 | 2/2002 | Takeya et al. | |
| 2002/0033851 | A1 | 3/2002 | Waldner et al. | |
| 2002/0033865 | A1 | 3/2002 | Ishinaga et al. | |
| 2002/0061389 | A1 | 5/2002 | Brooker et al. | |
| 2003/0020767 | A1 | 1/2003 | Saksa | |
| 2003/0029938 | A1 | 2/2003 | Vogel | |
| 2003/0043246 | A1 | 3/2003 | Codos | |
| 2003/0048343 | A1 | 3/2003 | Anderson | |
| 2003/0211251 | A1 | 11/2003 | Daniels | |
| 2003/0218650 | A1 | 11/2003 | Valero | |
| 2003/0218663 | A1 | 11/2003 | Baxter et al. | |
| 2004/0026017 | A1 | 2/2004 | Taylor et al. | |
| 2004/0028830 | A1 | 2/2004 | Bauer | |
| 2004/0094426 | A1 | 5/2004 | Lai | |
| 2004/0141764 | A1 | 7/2004 | Runkowske et al. | |
| 2004/0250947 | A1 | 12/2004 | Phillips et al. | |
| 2004/0257398 | A1 | 12/2004 | Otsuki | |
| 2004/0263544 | A1 | 12/2004 | Kojima | |
| 2005/0017995 | A1 | 1/2005 | Pferrer | |
| 2005/0133590 | A1 | 6/2005 | Rettenmyer et al. | |
| 2005/0204593 | A1 | 9/2005 | Bilger et al. | |
| 2005/0274272 | A1 | 12/2005 | Machesky | |
| 2006/0021535 | A1 | 2/2006 | Kaiser | |
| 2006/0023018 | A1 | 2/2006 | Hatayama | |
| 2006/0046326 | A1 | 3/2006 | Kok et al. | |
| 2006/0075917 | A1 | 4/2006 | Edwards | |
| 2006/0162650 | A1 | 7/2006 | Kido et al. | |
| 2006/0228150 | A1 | 10/2006 | Hosokawa | |
| 2006/0275590 | A1 | 12/2006 | Lorenz et al. | |
| 2007/0044324 | A1 | 3/2007 | Harris | |
| 2007/0064030 | A1 | 3/2007 | Abergel et al. | |
| 2007/0091132 | A1 * | 4/2007 | Lim | 347/14 |
| 2007/0263043 | A1 | 11/2007 | Bradford et al. | |
| 2008/0151006 | A1 | 6/2008 | Nishio et al. | |
| 2008/0277630 | A1 | 11/2008 | Kiyoshima et al. | |
| 2010/0098887 | A1 | 4/2010 | Matsuishi et al. | |

FOREIGN PATENT DOCUMENTS

| | | | |
|---|---|---|---|
| CN | 1681656 | | 10/2005 |
| DE | 19532724 | | 3/1997 |
| DE | 19823195 | | 11/1999 |
| DE | 202004000662 | U1 | 4/2004 |
| DE | 202006000270 | U | 4/2006 |
| DE | 10 2005 020119 | B3 | 6/2006 |
| DE | 102005020119 | | 6/2006 |
| EP | 0095046 | | 11/1983 |
| EP | 0494363 | | 7/1992 |
| EP | 0993903 | | 4/2000 |
| EP | 1225053 | | 7/2002 |
| EP | 1435296 | | 7/2004 |
| EP | 1479524 | | 11/2004 |
| EP | 1714884 | | 10/2006 |
| EP | 1726443 | | 11/2006 |
| FR | 2601265 | | 1/1988 |
| GB | 722485 | | 1/1955 |
| GB | 2335885 | | 10/1999 |
| JP | 2006164 | | 1/1990 |
| JP | 10157245 | | 6/1998 |
| JP | 10226045 | | 8/1998 |
| WO | WO0148333 | | 7/2001 |
| WO | WO 02/00449 | | 1/2002 |
| WO | WO2004016438 | | 2/2004 |
| WO | WO 2005/009735 | | 2/2005 |

OTHER PUBLICATIONS

U.S. Appl. No. 11/765,196, filed Jun. 19, 2007.
U.S. Appl. No. 11/935,924, filed Nov. 6, 2007.
U.S. Appl. No. 11/940,135, filed Nov. 14, 2007.
U.S. Appl. No. 12/055,904, filed Mar. 26, 2008.
U.S. Appl. No. 12/118,389, filed May 9, 2008.
U.S. Appl. No. 11/765,196, Apr. 1, 2010 Non-Final Office Action.
U.S. Appl. No. 11/765,196, Jul. 2, 2010 Response to Non-Final Office Action.
U.S. Appl. No. 11/935,924, Feb. 23, 2010 Non-Final Office Action.
U.S. Appl. No. 11/935,924, May 24, 2010 Response to Non-Final Office Action.
U.S. Appl. No. 11/935,924, Jun. 28, 2010 Notice of Allowance & Examiner's Amendment.
U.S. Appl. No. 11/940,135 Apr. 5, 2010 Non-Final Office Action.
U.S. Appl. No. 11/940,135, Aug. 5, 2010 Response to Non-Final Office Action.
U.S. Appl. No. 12/055,904, Apr. 2, 2010 Non-Final Office Action.
U.S. Appl. No. 12/055,904, Jul. 2, 2010 Response to Non-Final Office Action.
European Search Report for counterpart Application No. EP 06 01 7767, Oct. 2006.
U.S. Appl. No. 11/765,196, Dec. 16, 2010 Response to Final Office Action.
U.S. Appl. No. 12/055,904, Dec. 16, 2010 Final Office Action.
U.S. Appl. No. 11/632,461, Dec. 21, 2010 Non-Final Office Action.
U.S. Appl. No. 11/940,135, Jan. 4, 2011 Response to Final Office Action.
U.S. Appl. No. 11/765,196, Sep. 22, 2010 Final Office Action.
U.S. Appl. No. 12/055,904, Sep. 30, 2010 Supplemental Response to Non-Final Office Action.
U.S. Appl. No. 11/940,135, Oct. 4, 2010 Final Office Action.
U.S. Appl. No. 11/765,196, Jan. 18, 2001—Non-Final Office Action.
U.S. Appl. No. 11/940,135, Jan. 19, 2011—Advisory Action.
U.S. Appl. No. 11/960,121, Feb. 18, 2011—Non-Final Office Action.
U.S. Appl. No. 11/940,135, Mar. 4, 2011—Supplemental Response to Final Office Action.
U.S. Appl. No. 11/940,135, Mar. 21, 2011—Non-Final Office Action.
U.S. Appl. No. 11/632,461, Mar. 21, 2011—Response to Non-Final Office Action.
U.S. Appl. No. 12/055,904, Apr. 8, 2011—Non-Final Office Action.
U.S. Appl. No. 12/118,389, May 23, 2011—Non-Final Office Action.
Summary of ISO 2817 and 2813, International Organization for Standard, (no date available).
"Numerical Investigation of Droplet Impact Spreading in Spray Coating of Paper", Advanced Coating Fundamentals Symposium, (Spring 2003).
U.S. Appl. No. 11/632,461, Final Rejection dated Jun. 15, 2011.
U.S. Appl. No. 11/765,196, Response to Non-Final Rejection dated May 17, 2011.
U.S. Appl. No. 11/765,196, Final Rejection dated Jun. 30, 2011.
U.S. Appl. No. 12/055,904, Response to Non-Final Rejection dated Jul. 8, 2011.

* cited by examiner

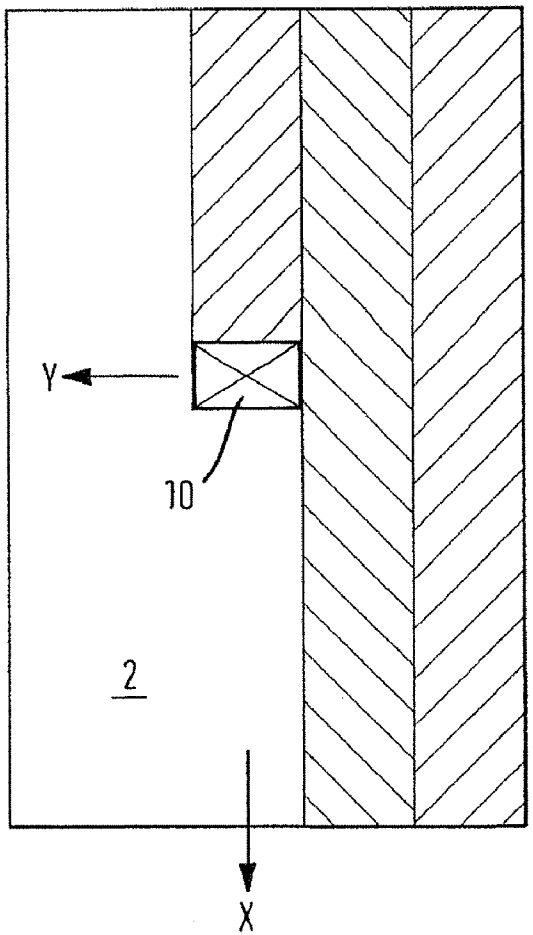
Fig. 6
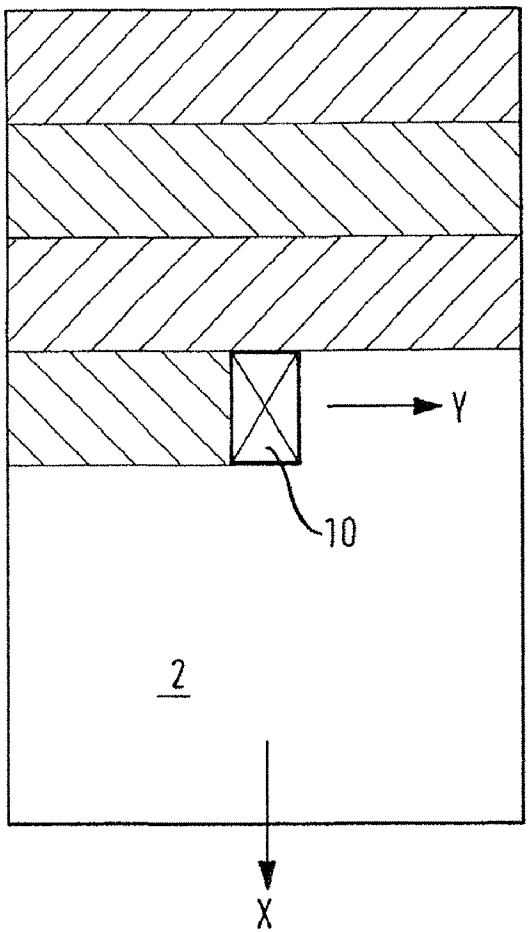

DEVICE FOR PATTERNING WORKPIECES

CROSS-REFERENCE TO RELATED APPLICATIONS

This application claims priority to European Patent Application 06017767.2, filed Aug. 25, 2006, which is incorporated by reference in its entirety herein.

TECHNICAL FIELD

The invention relates to a device for patterning workpieces, which preferably consist at least partially of wood, wood materials or the like, according to the preamble of claim

BACKGROUND OF THE INVENTION

A device of the type mentioned at the outset is known, for example, from DE 100 31 030 B4 and has sensors for roughly detecting the contour and thickness of the workpieces to be imprinted which are attached to a conveyor device or to a portal. Nevertheless, it has been found that the workpieces imprinted using a device of this type often have a poor-quality printed image.

Furthermore, European patent application EP 05 009 326.9, which was filed by the Applicant and has not yet been published, also relates to a device according to the preamble of claim 1.

SUMMARY OF THE INVENTION

The object of the present invention is therefore to provide a device of the same type for patterning workpieces that allows an improved printed image quality.

According to the invention, this object is achieved by a device according to claim 1. Particularly advantageous developments of the invention are specified in the dependent claims.

The invention is based on the finding that the printed image in workpieces is impaired above all as a result of the fact that, in known devices, the print head and workpiece are not positioned with sufficient precision relative to each other and are thus printed with imprecise "register". In some cases, this leads to certain regions of the workpiece being imprinted twice or an "overspray" being produced, i.e. printing is carried out beyond a free edge of the workpiece and ink mist is deposited on an adjacent surface of the workpiece.

Against this background, the invention provides for the detection means to be disposed and configured so as to be in a predetermined, fixed relationship to the ink-jet printing means and/or to detect at least the distance between the ink-jet printing means and at least one surface to be patterned of the respective workpiece to be patterned, at least during printing.

With a view to the common aim of improving relative positioning, the invention therefore provides two alternative (and also combinable) solutions to the foregoing common problem. An improvement in the printed image is in any case achieved, in accordance with the invention, by optimising the relative positioning between the workpiece and printing means.

The detection means, which is disposed in a predetermined, fixed relationship to the printing means, allows any deviations resulting, for example, from conveyance movements of the conveyor means, temperature fluctuations or the like to be eliminated so that the precision of the relative positioning and thus the print quality can be greatly increased. Similarly, this also applies to the measure according to the invention of detecting not only the contour or position of the workpiece but also the distance thereof from the printing means. As a result, either the position relative to a desired value can be corrected or the operation of the printing device can be adapted to the detected actual value of the distance.

Although within the scope of the invention the use of at least one ink-jet printing means is preferred, other printing means can also be used alternatively or additionally.

Within the scope of the invention it is, in principle, possible to dispose the ink-jet printing means in a stationary manner and to feed the workpieces to be patterned along said printing means using the conveyor device. It is also possible to make the printing means movable or else to provide a combination of both variations, i.e. that both the workpieces and the printing means are moved during the printing process using the conveyor device.

Although within the scope of the present invention the detection means can be disposed at any desired location, it has been found to be advantageous, with regard to the predetermined, fixed relationship to the printing means, for the detection means to be disposed at least partially on the printing means. This allows possible deviations to be minimised particularly effectively, especially if sensors of the detection means, which will be examined in greater detail hereinafter, are disposed in the region of the nozzles of the printing means.

In addition to the above-discussed detection means, the device according to the invention further has, according to a development of the invention, a rough detection means which is preferably stationary. In this way, the contour and position of each workpiece can be detected, initially using the rough detection means, before a substantially more precise relative position can then be determined using the (fine) detection device which is disposed in a fixed relationship to the printing means. This two-stage construction of the device allows rapid operation with high print quality.

According to a development of the invention, the detection means and/or the rough detection means each has a plurality of sensors, in particular distance sensors. It is particularly preferred in this regard for at least one of the sensors to be disposed so as to be able to rotate and/or move about at least one axis. Not only does this allow the sensors to be used variably, rotating and/or moving the sensors allows a minimum or maximum distance to be detected with a plurality of measurements.

With regard to the predetermined, fixed disposal of the detection means in relation to the printing means, a development of the invention provides for at least one of the sensors to be disposed on the printing means. In the case of the rough detection means, on the other hand, it is preferred for at least one of the sensors to be disposed on the workpiece carrier means. This provides respectively optimum detection results which are adapted to the aim and purpose of the respective (rough) detection means.

In the case of the sensors disposed on the printing means, it has been found to be advantageous for at least one sensor to be disposed so as to detect in the direction in which the drops of ink from at least one nozzle are expelled. This allows the detection results of the detection means to be optimally evaluated for the printing operation.

According to a development of the invention, it has also proven advantageous for at least one sensor to be disposed on the printing means via a movable and/or pivotable element and therefore preferably to be able to be brought into a position in which the sensor detects in a direction substantially orthogonal to the direction in which the drops of ink from at least one nozzle are expelled. The pivotability or movability of the distance sensor allows it to be used for various types of measurement, for example for a pure distance measurement and for a thickness measurement, as will become even clearer from the detailed description hereinafter.

The present invention does not place any particular limitations on the type and configuration of the respective sensors. They may, for example, be ultrasonic sensors, laser pointers and a further large number of sensors. In addition, a further purpose of the invention provides for the detection means and/or the rough detection means each to have at least one image detection sensor which is preferably disposed on the printing unit. The provision of an image detection sensor opens up entirely new possibilities to detect and to evaluate for further operation not only the geometry of the workpiece but also numerous further properties such as, for example, the nature and quality of the printed image applied. In particular, not only does the image detection sensor detect geometrical data in a point-by-point manner or locally; there is obtained an image detail which contains a large amount of information and can be evaluated as a whole. The information thus obtained can be used not only for the above-discussed relative positioning but also for general inspection of the printing result and for calibrating the print head, so the quality of the printing result can be further improved in this respect too.

In order to allow the print head to respond rapidly and precisely to detection results of the detection means and/or rough detection means, a further development of the invention provides for at least the nozzles of the printing means to be adjustable at least in groups via adjustment means, in particular piezo adjustment means.

According to a development of the invention, the device further comprises at least one beam-like guide means, in particular a portal or a jib. A guide means of this type is particularly suitable for attaching and guiding the printing means, wherein the printing means can, for example, be movable in the longitudinal direction of the guide means and the guide means itself can, for its part, also be movable.

Furthermore, a development of the invention provides for at least one beam-like guide means to have at least one spindle unit which is preferably movable along the beam-like guide means and/or pivotable about an axis. Within the scope of the present invention, numerous tasks can be assigned to a spindle unit of this type. On the one hand, it can be used to receive the printing unit, for example to receive it in an insertable and exchangeable manner. Alternatively or additionally, the spindle unit can also be used to receive machining tools and/or machining installations which are used in the machining and refinement of workpieces of the type in question. These may be simple drills or milling cutters or else complex installations such as edge-banding installations.

Furthermore, the invention provides a method for patterning workpieces using a device according to the invention, which method has the features of claim 13. The core of the method is selectively to alter, i.e. in particular to switch on or off, nozzles of the ink-jet printing means based on a detection result of the detection means. This allows extremely rapid and flexible response to possible desired/actual value deviations during operation of the device, so the print quality can be improved in a simple and reliable manner.

BRIEF DESCRIPTION OF THE DRAWINGS

FIG. 6 illustrates the operation of the device shown in FIG. 1.

DETAILED DESCRIPTION

Preferred embodiments of the present invention will be described hereinafter in detail with reference to the accompanying drawings.

Figure 1:
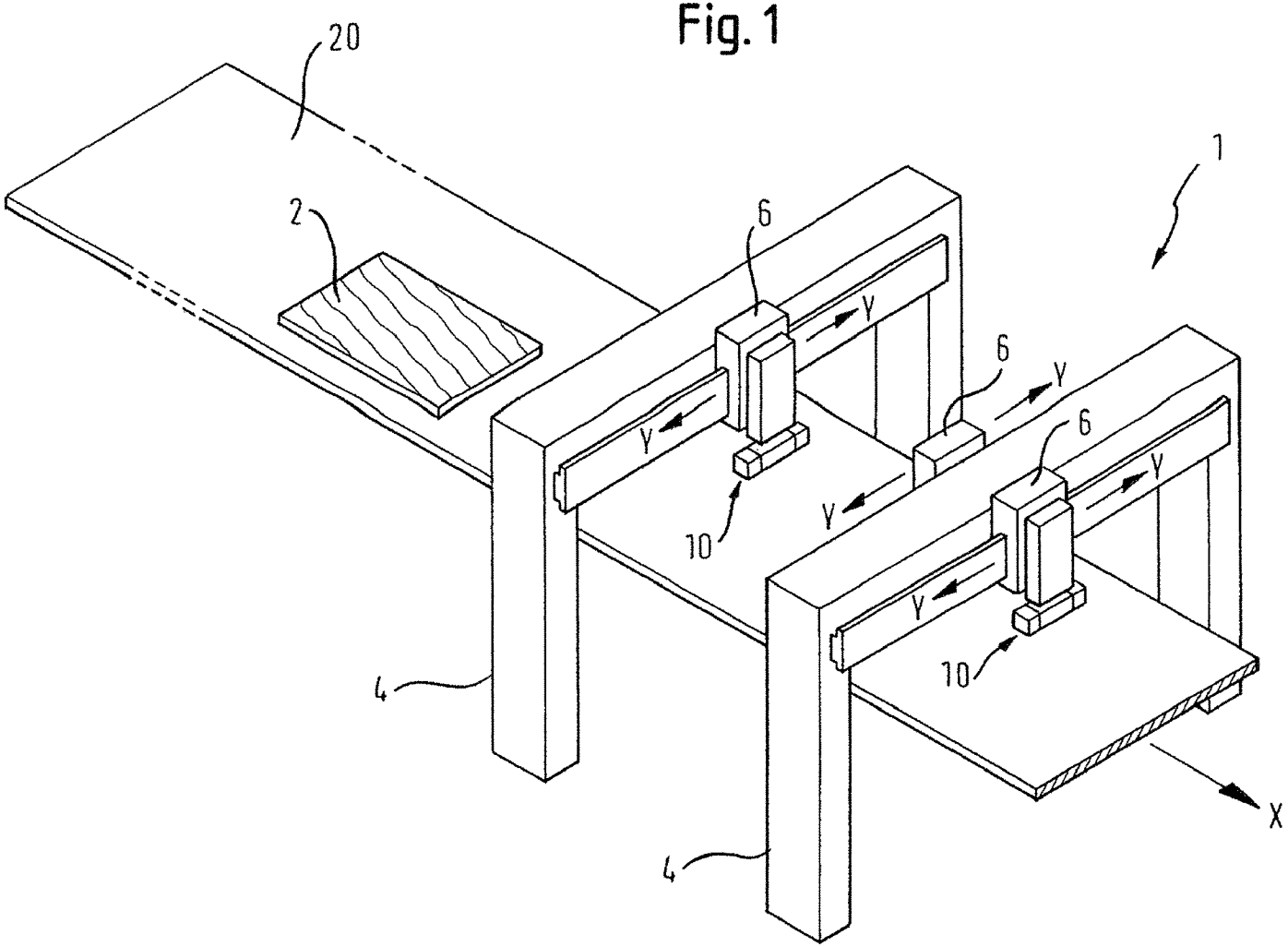
FIG. 1 is a schematic perspective view of a device for patterning workpieces according to an embodiment of the invention.

FIG. 1 is a schematic perspective view of a device 1 for patterning workpieces as a preferred embodiment of the present invention. The device is used for patterning workpieces 2 which, in the preferred embodiment, consist at least partially of wood, wood materials, plastics materials or the like, such as are frequently used in the field of furniture and kitchen design.

The device 1 comprises an ink-jet printing means 10 which, in the present embodiment, operates in accordance with the drop-on-demand principle. As may be seen most clearly in FIG. 4, the ink-jet printing means 10 comprises a plurality of nozzles 12 from which drops of ink can be expelled and which, in the present embodiment, are disposed in a plurality of rows, each row being provided for expelling a predetermined colour, for example the colours cyan, magenta, yellow and black.

Also provided on the printing means 10 are drying units 14, for example UV driers, which are used promptly to dry the ink applied by the printing means in order to prevent possible distortion or smudging of the printed image.

The printing means 10 is in the present embodiment provided on or inserted into a spindle unit 6, although this is not shown in detail in FIG. 1. The spindle unit is preferably a spindle unit which is also suitable for the insertable and exchangeable receiving of machining tools or machining installations. The spindle unit 6 is provided on a portal 4 so as to be movable in the y direction, wherein the portal may itself, in turn, be configured so as to be movable in the x direction. In this regard, the present embodiment provides two portals 4 which can each carry one or a plurality of spindle units 6 which may optionally be disposed on opposing sides of the respective portal 4. It should be noted in this regard that the portals 4 may, if appropriate, also be configured as jibs. The spindle units 6 can be automatically or manually fitted via tool magazines (not shown in detail in this case) with machining tools and/or machining installations and one or more printing means 10.

In the present embodiment, there extends below the portals 4 a workpiece table 20 for carrying the respective workpieces 2 to be patterned, which table is movable in the x direction shown in FIG. 1. The workpiece table 20 can have a broad range of configurations and, for example, also be formed by a circulating conveyor belt or the like. On account of its movability, the workpiece table 20 forms at the same time a workpiece carrier means and a portion of the conveyor device according to the present invention.

Figure 2:
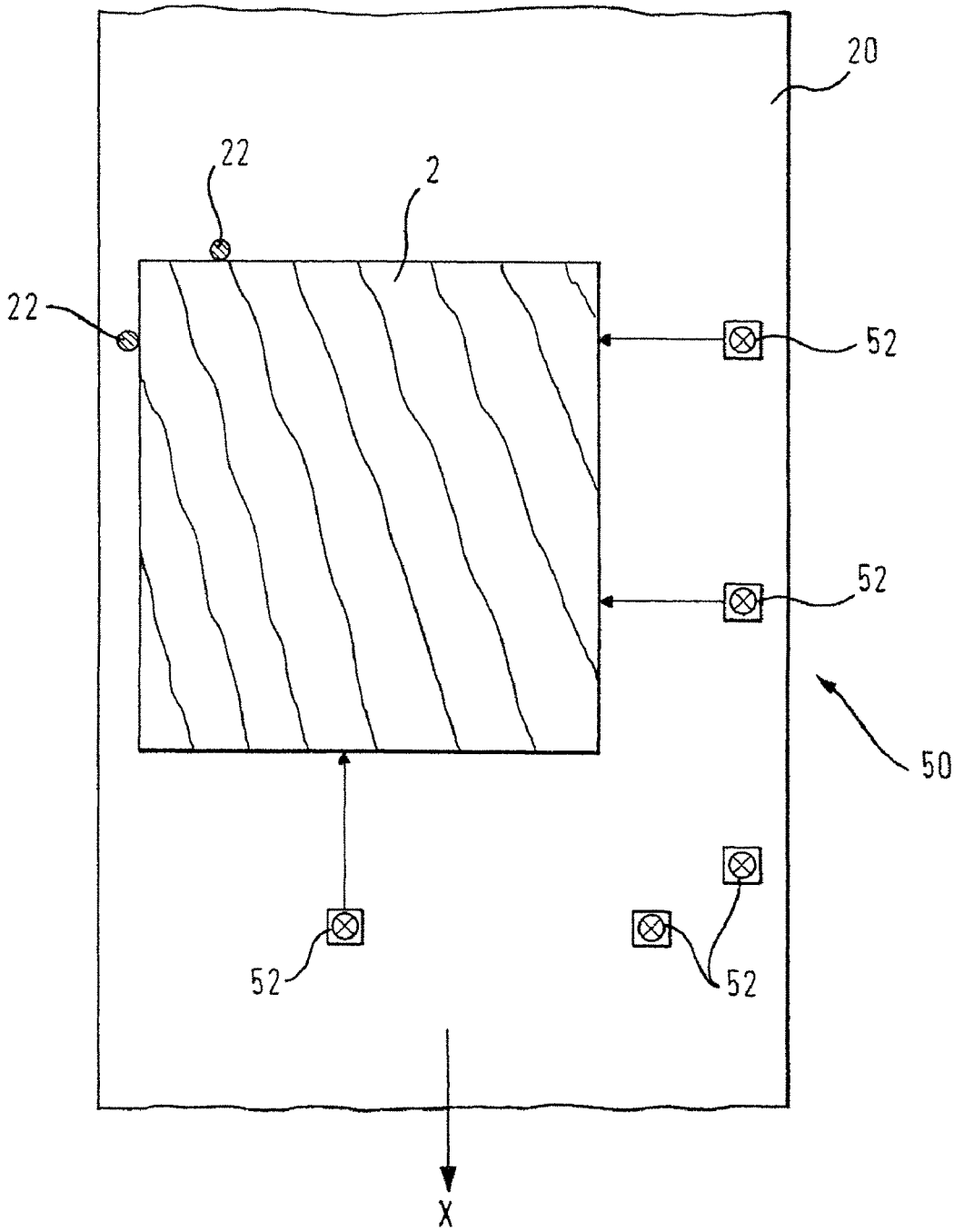
FIG. 2 is a schematic partial plan view of the device shown in FIG. 1.

FIG. 2 is a detailed plan view of the disposal of a plate-like workpiece 2 on the workpiece table 20. In the present embodiment, the workpiece table 20 has extensible stop pins 22 against which the workpiece 2 can be placed for rough positioning. Also disposed on the workpiece table 20 is a plurality of distance sensors 52 which are part of a rough detection means 50. The distance sensors shown in FIG. 2 are configured to detect the distance between the sensors and a lateral surface (narrow surface) of each workpiece 2. In the present embodiment, the sensors 52 are in this regard rotatable about an axis extending orthogonally to the surface of the workpiece table 20 and are optionally movable parallel to the surface. The rough detection means 50 is thus used for roughly detecting the geometry and positioning of each workpiece 2.

Figure 3:
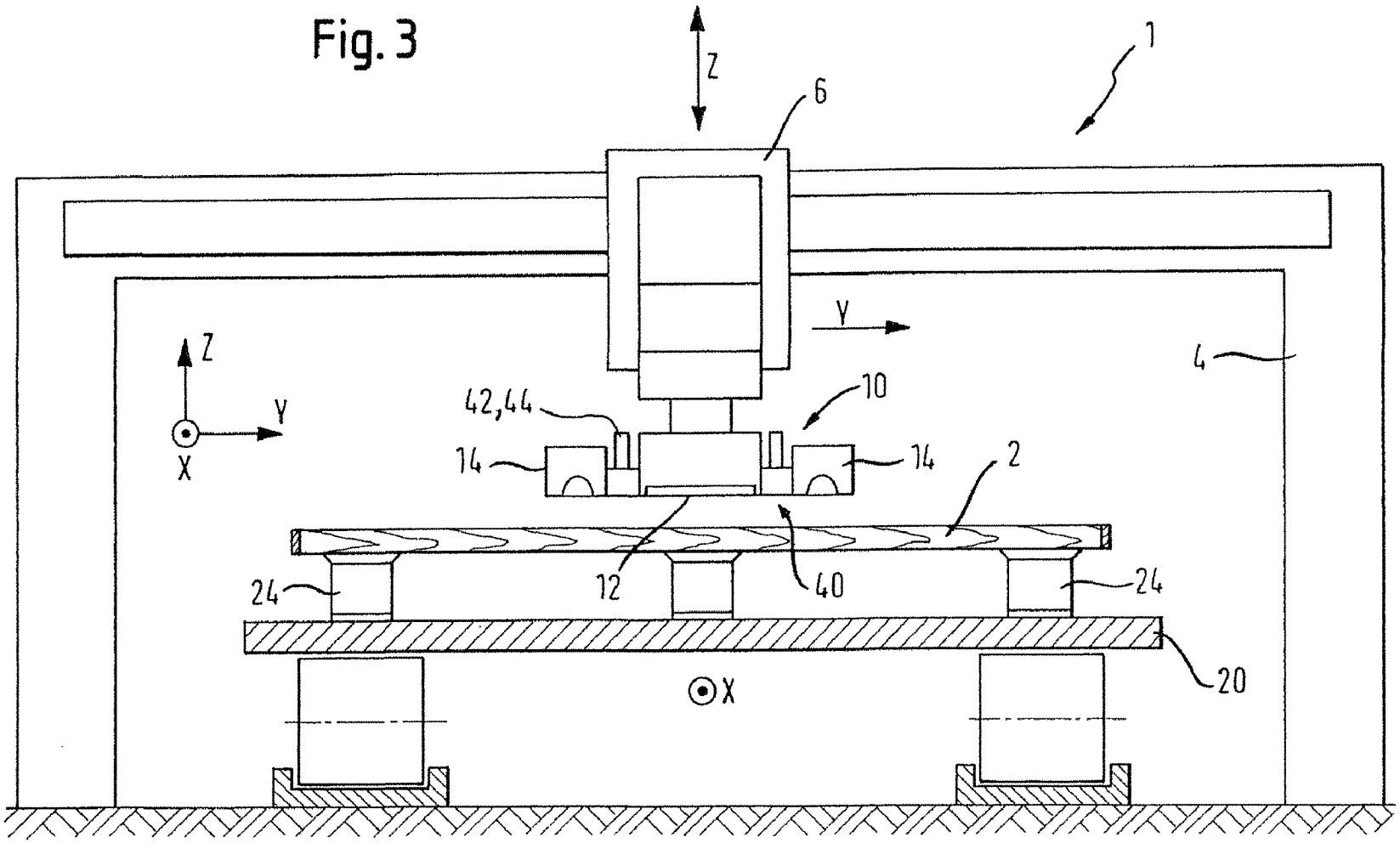
FIG. 3 is a schematic, partially cut-away front view of the device shown in FIG. 1.

Further details of the workpiece table 20 are shown in FIG. 3 which is a partially cut-away front view of the device shown in FIG. 1. It may be seen from FIG. 3 that the respective workpiece 2 may be fixed on the workpiece table 20, for example via vacuum suction means 24. It is also possible to integrate appropriate suction means or suction openings into the workpiece table or a workpiece belt.

Figure 4:
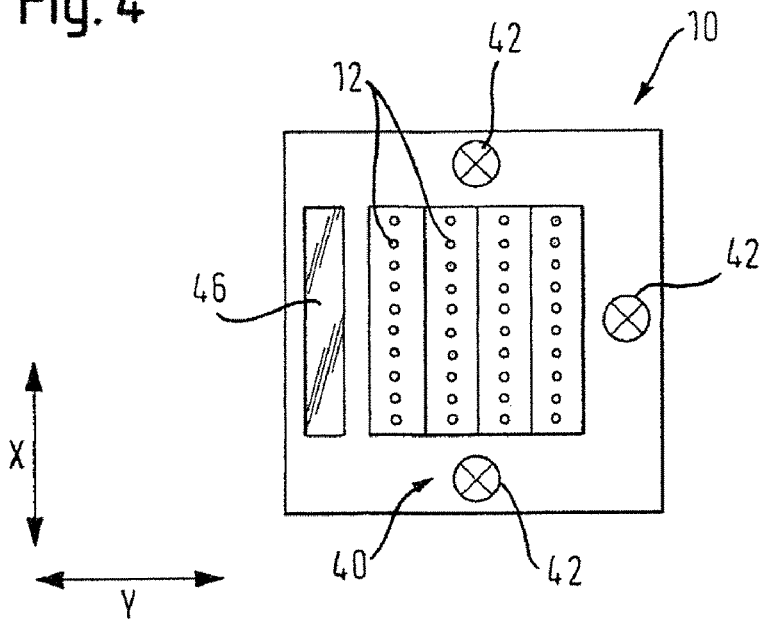
FIG. 4 shows further details of the printing means of the device shown in FIG. 1.

The device 1 according to the invention further comprises a detection means 40 for detecting the relative position of the ink-jet printing means 10 and the respective surface to be patterned of a workpiece 2. In the present embodiment, the detection means 40 has a plurality of types of sensors 42, 46 which can be seen most clearly in FIGS. 3, 4 and 5. In the present embodiment, the detection means 40 comprises first of all three distance sensors 42 which are disposed on the printing means 10 adjacently to the nozzles 12 and measure in a direction substantially parallel to the direction in which ink is expelled from the nozzles 12 (FIG. 4). On the one hand, these distance sensors can be used to determine the absolute distance between the printing means 10 and the workpiece 2; however, in addition, the precise contour of each workpiece 2 can also be inferred from the distance data obtained.

Figure 5:
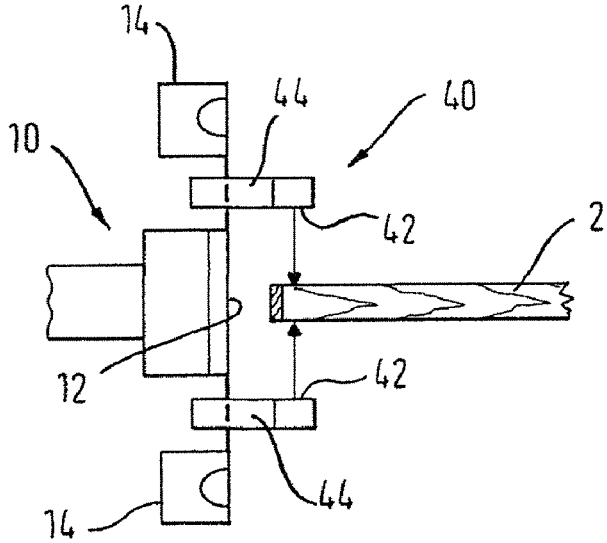
FIG. 5 shows further details of the printing means of the device shown in FIG. 1.

As may be seen most clearly in FIGS. 3 and 5, further distance sensors 42 are disposed on the printing means 10, in each case via an element 44 which, in the present embodiment, is able to pivot. The pivotable element 44 allows each sensor to be brought into an extended position which can be seen most clearly in FIG. 5. In this position, the sensors 42, shown in FIG. 5, measure in a direction substantially orthogonal to the direction in which ink is expelled from the nozzles 12. This allows the thickness or height of each region to be imprinted to be detected and an overspray to be avoided.

In addition, in the present embodiment, there is disposed on the printing means 10, adjacently to the ink expelling nozzles 12, an image detection sensor 46 which also measures in a direction substantially parallel to the direction in which ink is expelled from the nozzles 12. The image detection sensor 46 may, for example, be a CCD camera or the like which can produce a complete image of a region of the respective workpiece 2 that is to be imprinted or has already been imprinted.

Although not shown in the figures, all of the sensors, on the one hand, and the printing means and preferably also the remaining operating components of the device 1, on the other hand, are connected to a control means which evaluates the respective data collected by the sensors and on this basis controls the operation of the device, in particular of the printing means. The device may in this regard be operated as follows.

First of all, a workpiece 2 is roughly positioned on the workpiece table 20 via the stop pins 22 and fixed via the vacuum suction means 24. Subsequently, the positioning and/or contour of the workpiece 2 on the workpiece table 20 are detected by the sensors 52 and this data is forwarded to the control means.

The workpiece table 20 is then moved in the x direction, so the workpiece 2 can be machined or refined by tools, installations or printing units inserted into the spindle units 6. In this regard, the printing means is, for example, operated as follows.

Based on the data from the sensors 52, the printing means 10 is moved with the corresponding spindle 6 along the portal 4 to the workpiece 2 to be imprinted. In this regard, the sensors 42, 46 continuously perform a measuring operation, thus allowing the presence and, if appropriate, the distance of each workpiece and, in addition (by way of the image detection sensor 46), further information about the workpiece 2 to be obtained. Based on this data, the control means issues print signals to the respective nozzles 12 (or the associated piezoelectric actuators or thermocouples), so the workpiece 2 is imprinted. Individual nozzles or groups of nozzles can in this regard be switched on or off as a function of the detection data of the sensors 42, 46 in order to compensate for dimensional, positional or other tolerances or deviations of the workpiece 2. Alternatively or additionally, it is also possible, within the scope of the invention, for individual nozzles or a plurality of nozzles of the printing means 10 to be produced via piezo adjustment means or the like, in order to adapt the position or direction of expulsion thereof to the workpiece 2.

When imprinting a large lateral surface of a workpiece 2, there operate, in addition to the image detection sensor 46, primarily the sensors 42 which are disposed next to the nozzles 12 and can be seen most clearly in FIG. 4. In order to imprint a narrow surface of the workpiece 2, use is alternatively or additionally made of the sensors 42 which are extensible via pivotable elements 44 in order to detect the height of the narrow surface and thus to prevent an overspray.

Once a surface portion has been imprinted, it can optionally be dried by the drying units 14, if necessary simultaneously to the printing process.

FIG. 6 illustrates schematically the paths of movement of the printing means 10 and/or the workpiece 2. The left-hand drawing in FIG. 6 shows an operation in what is known as transverse printing in which the printing means 10 moves back and forth in the y direction, together with the spindle unit 6, along the portal 4, and the workpiece table 20 further clocks the workpiece 2 in the x direction.

Alternatively, it is also possible to use the printing model which is shown on the right-hand side in FIG. 6 and is referred to as longitudinal printing. In this model, the printing means 10 is itself substantially stationary during the printing process, and the workpiece 2 is moved back and forth in the x direction with the workpiece table 20. The printing means 10 has therefore merely to be further clocked in the y direction once the printing of a web is completed. In addition, within the scope of the present invention, combinations of both operations are also possible, and webs disposed, for example, obliquely or the like can be printed.

The invention claimed is:

1. A device for patterning wood or wood-containing workpieces, comprising:

a printing means configured as an ink-jet printing means having a plurality of nozzles from which drops of ink can be expelled, a control means for controlling the printing means, a workpiece carrier means for carrying the workpiece to be patterned, a conveyor means for bringing about a relative movement between the workpiece to be patterned and the printing means, and a detection means for detecting the relative position between the ink-jet printing means and at least one surface to be patterned of the respective workpiece to be patterned, wherein the detection means is disposed and configured so as to be in a predetermined, fixed relationship to the ink-jet printing means and/or to detect at least the distance between the ink-jet printing means and at least one surface of the respective workpiece to be patterned, wherein the detection means is further disposed on the printing means via a movable and/or pivotable element such that the detection means is capable of detecting along a direction substantially orthogonal to the direction in which the drops of ink from at least one nozzle are expelled, and wherein the control means is configured by the detection means to selectively switch the plurality of nozzles on and off.

2. A device according to claim 1, wherein the detection means is disposed at least partially on the ink-jet printing means.

3. A device according to claim 1, further comprising a rough detection means which is stationary.

4. A device according to claim 1, further comprising a rough detection means, wherein the detection means and/or the rough detection means each has a plurality of distance sensors.

5. A device according to claim 4, wherein at least one of the sensors is disposed so as to be able to rotate and/or move about at least one axis.

6. A device according to claim 4, wherein at least one of the sensors is disposed on the workpiece carrier means and/or at least one of the sensors is disposed on the printing means.

7. A device according to claim 6, wherein at least one sensor is disposed on the printing means so as to detect in the direction in which the drops of ink from at least one nozzle are expelled.

8. A device according to claim 1, wherein the detection means and/or the rough detection means each comprises at least one image detection sensor which is disposed on the printing means.

9. A device according to claim 1, wherein at least the nozzles of the printing means are adjustable at least in groups via adjustment means.

10. A device according to claim 1, further comprising at least one beam-like guide means that is a portal or a jib.

11. A device according to claim 10, wherein at least one beam-like guide means comprises at least one spindle unit which is movable along the beam-like guide means and/or pivotable about an axis.

12. A device according to claim 2, further comprising a rough detection means which is stationary.

13. A device according to claim 2, further comprising a rough detection means, wherein the detection means and/or the rough detection means each has a plurality of distance sensors.

14. A device according to claim 5, wherein at least one of the sensors is disposed on the workpiece carrier means and/or at least one of the sensors is disposed on the printing means.

15. A device according to claim 2, further comprising a rough detection means, wherein the detection means and/or the rough detection means each comprises at least one image detection sensor which is disposed on the printing means.

16. A device according to claim 2, wherein at least the nozzles of the printing means are adjustable at least in groups via adjustment means.

17. A device according to claim 16, wherein at least one beam-like guide means comprises at least one spindle unit which is movable along the beam-like guide means and/or pivotable about an axis.

18. A method for patterning wood or wood-containing workpieces comprising, (a) moving the workpiece relative an ink-jet printer having a plurality of nozzles from which drops of ink can be expelled;

(b) utilizing a detection means to detect the relative position between the ink-jet printer and at least one surface of the workpiece, wherein the detection means is disposed in predetermined, fixed relationship to the ink jet printer and/or is configured to detect at least the distance between the ink-jet printer and the at least one surface of the workpiece, and wherein the detection means is further disposed on the ink-jet printer via a movable and/or pivotable element such that the detection means is capable of detecting along a direction substantially orthogonal to the direction in which the drops of ink from at least one nozzle are expelled;

(c) selecting one or more of the plurality of nozzles based on the relative position between the ink-jet printer and the at least one surface of the workpiece, (d) utilizing a control means configured by the detection means to selectively switch one or more of the plurality of nozzles on and off; and (e) printing the at least one surface of the workpiece using the one or more selected nozzles of the ink-jet printer.

* * * * *